US007258337B1

(12) United States Patent
Spall

(10) Patent No.: US 7,258,337 B1
(45) Date of Patent: Aug. 21, 2007

(54) FLAG BLOCK FOR A DOCUMENT FEEDING SYSTEM

(75) Inventor: J. Michael Spall, Commerce, MI (US)

(73) Assignee: Unisys Corporation, Blue Bell, PA (US)

( * ) Notice: Subject to any disclaimer, the term of this patent is extended or adjusted under 35 U.S.C. 154(b) by 272 days.

(21) Appl. No.: 10/971,990

(22) Filed: Oct. 22, 2004

(51) Int. Cl.
*B65H 1/02* (2006.01)

(52) U.S. Cl. ..... 271/149; 271/126

(58) Field of Classification Search ..... 271/149, 271/160, 126, 150
See application file for complete search history.

(56) References Cited

U.S. PATENT DOCUMENTS 4,884,797 A * 12/1989 Svyatsky ..... 271/126
5,335,899 A * 8/1994 Golicz ..... 271/34
5,419,546 A 5/1995 Chen et al.
5,437,375 A 8/1995 Chen et al.
5,439,506 A 8/1995 Chen et al.
5,476,254 A * 12/1995 Golicz ..... 271/10.05
5,509,648 A 4/1996 Chen et al.
5,671,919 A 9/1997 Chen et al.
5,848,784 A 12/1998 Tranquilla
5,908,191 A 6/1999 Chen et al.
6,199,854 B1 3/2001 Tranquilla et al.
6,260,841 B1 7/2001 Tranquilla
6,270,070 B1 * 8/2001 Salomon et al. ..... 271/111
6,417,221 B1 7/2002 Meltzer et al.
6,474,637 B1 11/2002 Spall et al.

* cited by examiner

*Primary Examiner*—Patrick Mackey
*Assistant Examiner*—Kaitlin Joerger
(74) *Attorney, Agent, or Firm*—Richard J. Gregson; Brooks Kushman P.C.

(57) ABSTRACT

A system for feeding and transporting documents includes a feeder stage and a transport stage. Documents are fed singly, in order, from a stack of documents in a hopper assembly. A flag/flag block arrangement provides a force to move the documents along the hopper floor toward the feeder and to feed a document with a presentation force. The flag block includes a horizontal element for concentrating the presentation force at a desired position at the feeder. The horizontal element has sufficient depth away from the feeder such that the documents are essentially free to expand, thereby concentrating the presentation force while reducing drag forces. The flag/flag block arrangement is useful, for example, when the system is used to process envelopes.

13 Claims, 2 Drawing Sheets

FLAG BLOCK FOR A DOCUMENT FEEDING SYSTEM

BACKGROUND OF THE INVENTION

1. Field of the Invention

The invention relates to systems for feeding and transporting documents, to document hoppers used in these systems, and to adapting these systems for feeding envelopes and the like.

2. Background Art

A typical system for feeding and transporting documents includes a feeder in the document feeding portion of the system, and a series of roller pairs or belts in the document transporting portion of the system. In the feeding portion of the system, the feeder acts to separate and feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. Further, the components in the transporting portion of the system may take a variety of forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546; 5,437,375; 5,439,506; 5,509,648; 5,671,919; and 5,908,191 describe examples of other document operations.

As modern document handling devices are typically fitted with an automatic feeder mechanism to singly introduce documents into a track for further processing, a hopper is usually associated with the feeder so that the machine can load a number of documents to be processed. As feed rates increase, and feed mechanism reliability improves, there are advantages to making hopper capacity larger.

The difficulty with making hopper capacity larger is one of consistency. Document feeders need to have a supply of documents presented to the feeding mechanism in a consistent manner. This is a task of the document hopper. The variety of documents used in different applications make such consistent presentation difficult.

There is an ideal set of forces for feeding a document in a given feeder. The closer each document can be to this ideal set of forces, the better feeder performance will be. More specifically, the feeder must apply enough pinch force to allow the document to feed, but not so much as to result in the tearing apart of the document during feeding. As hopper capacity is increased, the variation in force against the stack between that needed to move a full hopper of documents and that needed to move the last few documents and provide an acceptable force to the document being fed is increased.

Typically, some form of mechanical intervention urges the document stack along in the hopper. An existing form of mechanical intervention used to urge the document stack along in the hopper toward the feeding mechanism applies a force to the document stack with a flag. Various approaches have been taken for driving the flag to produce the flag force or flag weight against the document stack.

Additional background information may be found in U.S. Pat. Nos. 6,474,637; 6,417,221; and 6,260,841.

Document processing systems are normally built to handle single thickness items, one at a time. Considerable effort (for example, double document detectors) goes into ensuring that only one thickness of paper is fed at a time. Further, a stack of single thickness items tends to be firm, and of consistent dimension.

In certain applications, it would be desirable to process envelopes in a document processing system. For example, automatic teller machine (ATM) envelopes could be imaged by the document processing system to capture information therefrom. In this way, it would not be necessary to copy the information from the envelopes to additional documents.

However, envelope stacks (for example, a stack of ATM envelopes) are spongy. This is due to the folded nature of the envelope construction. More specifically, the folded nature of the envelope construction changes the thickness of an envelope depending on location, and entrains air in the envelope stack because the folds are not of zero radius. Accordingly, envelope stacks are only processed with limited performance due to the fact that document processing systems are normally built to handle single thickness items.

For the foregoing reasons, there is a need for an improved system for feeding and transporting documents that is capable of feeding envelopes and the like with improved performance.

SUMMARY OF THE INVENTION

It is, therefore, an object of the invention to provide an improved system for feeding and transporting documents that is able to process envelope stacks with improved performance by utilizing an improvement to the flag in the form of a flag block. In a preferred approach to providing the flag block, it is possible to quickly convert a standard sorter to cope with stacks of envelopes with minimal alteration, and to allow reversion to standard configuration.

In carrying out the invention, a system for feeding and transporting documents is provided. Each document has a leading edge and a trailing edge. The system comprises a feeder stage and a transport stage. The feeder stage includes a hopper assembly and a feeder. The feeder acts to feed documents singly, in order, from a stack of documents provided by the hopper assembly. The hopper assembly includes a hopper floor that carries the stack of documents, and a flag that provides a horizontal force to move documents along the hopper floor toward the feeder. The transport stage is downstream of the feeder stage for receiving the fed documents.

According to the invention, a flag block is used to improve performance when feeding envelopes. The flag block can be attached to the existing flag when a need arises to feed envelopes. It also would be possible, for certain applications, to form the flag block integrally as part of the standard flag configuration. In either approach, the flag block comprises a horizontal element for concentrating the flag force in the desired position on the nudger belt or equivalent structure. This horizontal element is shaped so that it essentially does not apply any force anywhere else such that the envelope stack may expand freely. In this way, it is possible to maximize the nudging force, minimize the drag force, and generally cause the feeder to behave as though it is feeding single thickness items.

Put another way, the flag block horizontal element has considerable depth in order to cope with the spongy nature of the envelope stack. Force can thus be concentrated on the nudger belt as desired, while it is possible to eliminate force against stationary features. That is, the horizontal element has depth away from the feeder. Thus, the documents are essentially free to expand for the purpose of improving feeder behavior.

In a preferred approach, the invention comprehends a number of additional features relating to the flag block which are further described below. A vertical element may be attached below the horizontal element, at the feed nip end. The vertical element is for supporting the last item in the stack, if the item is a small check or stub. Otherwise, small items could drag under the horizontal element and fail to feed.

According to another preferred feature, the face of the horizontal element which meets the nudger belt is concave. The purpose of this feature is to column form the last document in a stack. This stiffens the column formed document in the direction of travel, making it easier to feed. Envelopes are relatively heavy, and feed better with higher feeding forces. Light documents, such as intermixed stubs, would perform better with lighter feeding forces. When the ability to adjust feeding force is unavailable, by column forming light items, these items may be fed successfully at higher feeding forces. Put another way, the concave face of the horizontal element has an axis parallel to the direction of feeding. This concavity column forms the last few documents in the stack, and provides better feeding for light documents which may be intermixed with the envelopes.

In yet another preferred feature, the flag block may be attached to the existing flag with a combination of pins and a thumb screw. Thus, by removing the single thumb screw, which does not require tools, and then the flag block assembly, the machine may be returned to its regular stock configuration in seconds by the machine operator.

The invention provides numerous advantages for a document feeding system. In a preferred approach, a machine may be convertible to multiple tasks by the operator, at minimum cost, without a service call.

DETAILED DESCRIPTION OF THE PREFERRED EMBODIMENT

Figure 1:
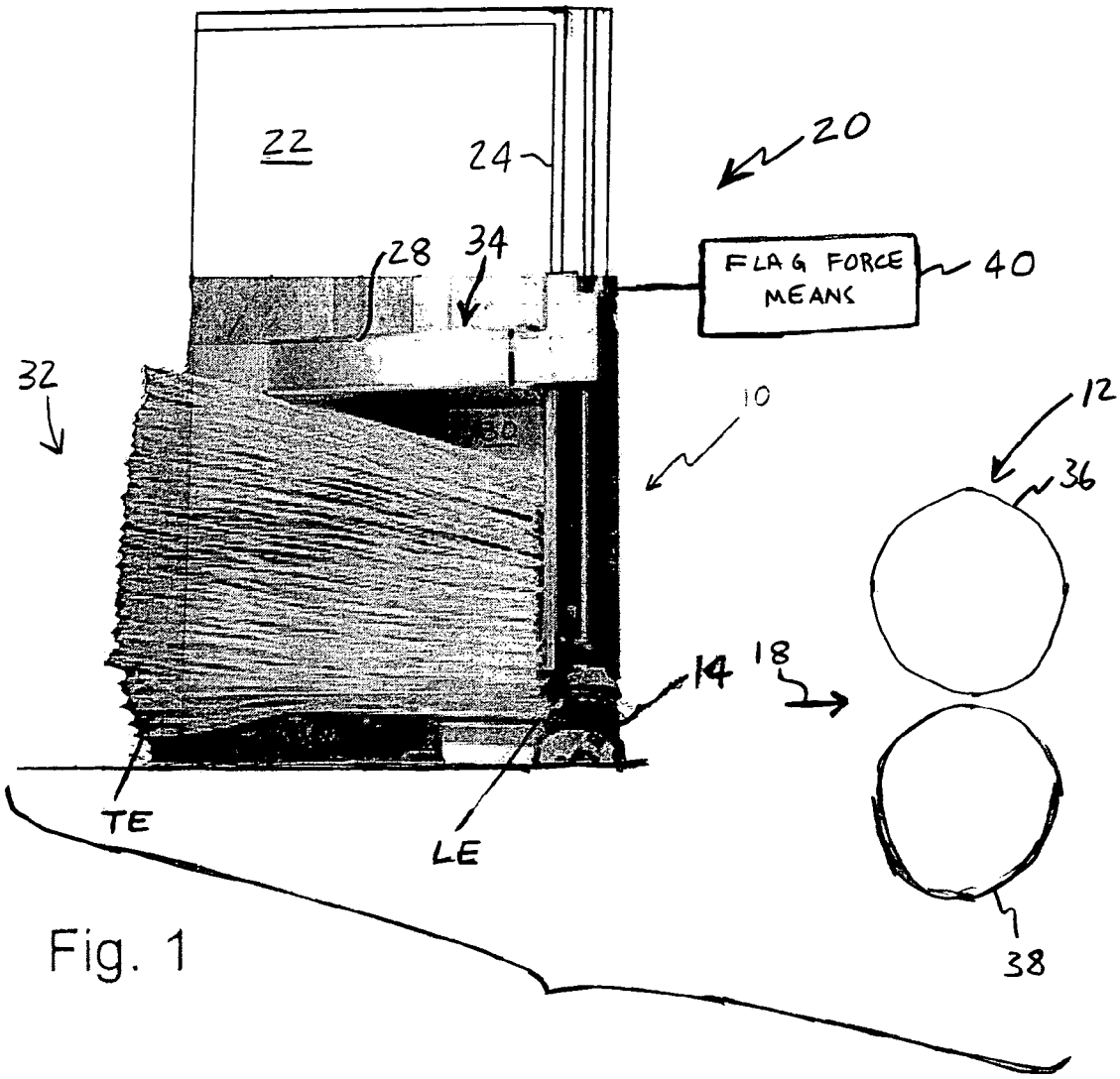
FIG. 1 is a plan view illustrating an exemplary system for feeding and transporting documents in accordance with the invention.

FIG. 1 illustrates a system for feeding and transporting documents. The system includes a feeder stage 10 and a transport stage 12. The feeder stage 10 includes a feeder including nudger belt 14. Transport stage 12 is downstream of feeder stage 10, with arrow 18 pointing in the downstream direction. A document leading edge LE is the more downstream edge, while the trailing edge TE is the more upstream edge. Feeder stage 10 includes hopper assembly 20. Hopper assembly 20 includes a hopper floor 22 and hopper sidewall 24. Hopper assembly 20 further includes document stack supporter or flag 28. Flag block 30 is attached to flag 28. A stack 32 of documents, the documents being envelopes, engages hopper floor 22, flag 28 and flag block 30.

With continuing reference to FIG. 1, envelope stack 32 is shown adjacent to hopper sidewall 24. The components shown in FIG. 1 are exemplary and alternative arrangements are possible as known to those skilled in the art. For example, the feeder is shown as a nudger belt 14, but may take other forms. Further, the components in the transporting portion 12 may take a variety of forms as known to those skilled in the art, but for convenience of understanding are shown as an accelerator idler wheel 36 and an accelerator drive wheel 38 that rotates clockwise. The downstream accelerator wheel pair 36, 38 accepts the document from the feeder.

The flag/flag block assembly 34, composed of flag 28 and flag block 30, provides a force to move envelope stack 32 along hopper floor 22 toward nudger belt 14. Assembly 34 is biased to urge envelope stack 32 toward the feeder by flag force means indicated at block 40, which may take any suitable form such as a string or cable connected to a flag weight and/or spring.

Figure 2:
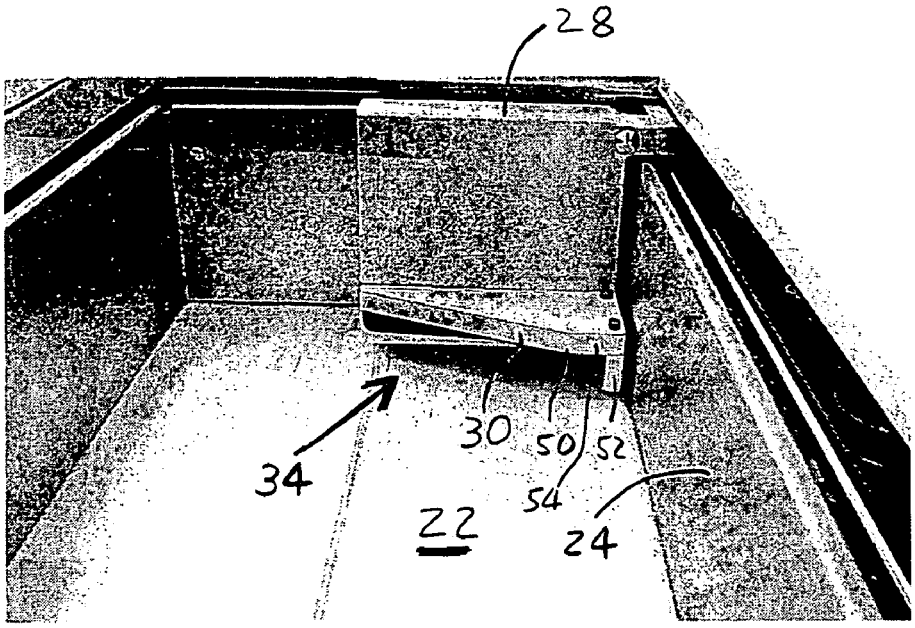
FIG. 2 is an enlarged perspective view of the document face of the flag/flag block assembly in the preferred embodiment.
Figure 3:
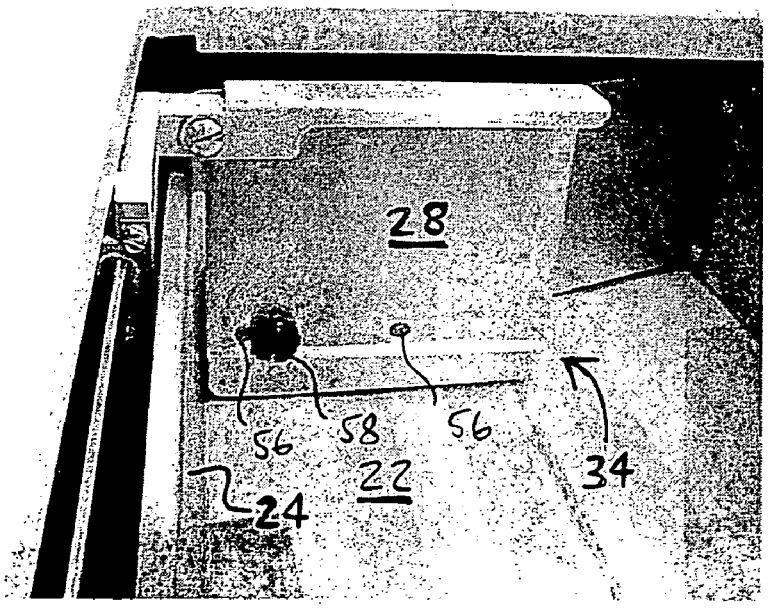
FIG. 3 is an enlarged perspective view of the rear of the flag assembly.

With reference to FIGS. 2-3, flag/flag block assembly 34 is shown in greater detail. Flag block 30 includes horizontal element 50. The main purpose of horizontal element 50 is to concentrate flag force in the desired position on nudger belt 14. Horizontal element 50 is somewhat triangular in shape so that it does not apply force anywhere else, and lets the envelope stack 32 expand freely. The considerable depth of horizontal element 50 enables it to cope with the spongy nature of the envelope stack 32. Forces can thus be concentrated on nudger belt 14, while eliminating forces against stationary features. In this way, it is possible to maximize the nudging force, minimize the drag forces, and generally cause the feeder to behave as though it is feeding single thickness items.

A vertical element 52 is attached below horizontal element 50, at the feed nip end. The purpose of vertical element 52 is to support the last item in a stack, if the item is a small check or stub. Otherwise, small items can drag under the horizontal element 50 and fail to feed. This allows the flag block 30 to successfully feed small documents which may be intermixed with the envelopes.

The face 54 of the horizontal element 50 which meets the nudger belt 14 is concave. The purpose for this concave face 54 is to column form the last document in a stack. This stiffens the column formed document in the direction of travel, making it easier to feed.

Envelopes are relatively heavy, and feed better with higher feeding forces. Light documents, such as intermixed stubs, would work better with lighter feeding forces, but such adjustment may not be available. By column forming light items, these items can be fed successfully at higher feeding forces. Horizontal element 50 of flag block 30 uses this concavity on face 54, whose axis is parallel to the direction of feeding, to column form the last few documents in the stack.

The flag block 30 described above can be attached to an existing flag 28 with a combination of pins and a thumb screw as best shown in FIG. 3. Pins 56 locate flag block 30 in the proper position on existing flag 28, and prevent rotation. A single thumb screw 58 is sufficient to hold flag block 30 on existing flag 28. Flag block 30 can be removed by releasing thumb screw 58. This can be performed by the machine operator, if desired. The existing flag 28 is left with three holes which are too small to impact document handling. Thus, the sorter can be returned to its original stock configuration for unrestricted handling of single thickness documents.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor having a near end at the feeder and a far end away from the feeder, the hopper floor carrying the document stack;

the hopper assembly further including a flag/flag block arrangement providing a force to move the documents along the hopper floor toward the feeder and to feed a document with a presentation force;

wherein the flag block includes a horizontal element for concentrating the presentation force at a desired position at the feeder, the horizontal element having depth away from the feeder such that the documents are essentially free to expand, thereby concentrating the presentation force at a desired location while reducing drag forces on the fed document;

a transport stage downstream of the feeder stage for receiving the fed documents; and wherein the flag block includes a vertical element attached below the horizontal element at the feeder end of the horizontal element, the vertical element supporting a last document in the document stack.

2. The system of claim 1 wherein the flag/flag block arrangement includes a flag and a flag block wherein the flag block is removably attachable to the flag.

3. The system of claim 2 wherein the flag block may be attached to the flag with a combination of pins and a thumb screw.

4. The system of claim 1 wherein the horizontal element is triangular in shape so as to concentrate the presentation force at the desired location.

5. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor having a near end at the feeder and a far end away from the feeder, the hopper floor carrying the document stack;

the hopper assembly further including a flag/flag block arrangement providing a force to move the documents along the hopper floor toward the feeder and to feed a document with a presentation force;

wherein the flag block includes a horizontal element for concentrating the presentation force at a desired position at the feeder the horizontal element having depth away from the feeder such that the documents are essentially free to expand, thereby concentrating the presentation force at a desired location while reducing drag forces on the fed document;

a transport stage downstream of the feeder stage for receiving the fed documents; and wherein a face of the horizontal element at the feeder end is concave to column form a last document in the document stack, thereby stiffening the document in the direction of travel.

6. The system of claim 5 wherein the flag/flag block arrangement includes a flag and a flag block wherein the flag block is removably attachable to the flag.

7. The system of claim 6 wherein the flag block may be attached to the flag with a combination of pins and a thumb screw.

8. The system of claim 5 wherein the horizontal element is triangular in shape so as to concentrate the presentation force at the desired location.

9. A method for use in a system for feeding and transporting documents, each document having a leading edge and a trailing edge, the system including a feeder stage including a hopper assembly and a feeder wherein the feeder acts to feed documents singly, in order, from a stack of documents in the hopper assembly, the hopper assembly including a hopper floor having a near end at the feeder and a far end away from the feeder, the hopper floor carrying the document stack, the hopper assembly including a flag providing a force to move the documents along the hopper floor toward the feeder, the system further including a transport stage downstream of the feeder stage for receiving the fed documents, the method comprising:

applying a force to move the documents along the hopper floor toward the feeder and to feed a document with a presentation force, including concentrating the presentation force at a desired position at the feeder, such that the documents are essentially free to expand in a region away from the feeder against a flag/flag block arrangement wherein the flag block includes a horizontal element with depth away from the feeder, thereby concentrating the presentation force at a desired location while reducing drag forces on fed documents; and wherein a face of the horizontal element at the feeder end is concave to column form a last document in the document stack, thereby stiffening the document in the direction of travel.

10. The method of claim 9 wherein the flag/flag block arrangement includes a flag and a flag block wherein the flag block is removably attachable to the flag.

11. The method of claim 10 wherein the flag block may be attached to the flag with a combination of pins and a thumb screw.

12. The method of claim 9 wherein the flag block includes a vertical element attached below the horizontal element at the feeder end of the horizontal element, the vertical element supporting a last document in the document stack.

13. The method of claim 9 wherein the horizontal element is triangular in shape so as to concentrate the presentation force at the desired location.

* * * * *